US011186780B1

(12) United States Patent
Long et al.

(10) Patent No.: US 11,186,780 B1
(45) Date of Patent: Nov. 30, 2021

(54) METHODS FOR PROCESSING OIL SANDS CONTAINING SWELLING CLAYS

(71) Applicant: SYNCRUDE CANADA LTD. in trust for the owners of the Syncrude Project as such owners exist now and in the future, Calgary (CA)

(72) Inventors: Jun Long, Edmonton (CA); Dana Doyle, Fort McMurray (CA); Adam Coffin, Fort McMurray (CA)

(73) Assignee: SYNCRUDE CANADA LTD. IN TRUST FOR THE OWNERS OF THE SYNERUDE PROJECT AS SUCH OWNERS EXIST NOW AND IN, Calgary (CA)

( * ) Notice: Subject to any disclaimer, the term of this patent is extended or adjusted under 35 U.S.C. 154(b) by 0 days.

(21) Appl. No.: 17/179,310

(22) Filed: Feb. 18, 2021

Related U.S. Application Data

(60) Provisional application No. 63/020,236, filed on May 5, 2020.

(51) Int. Cl.
*C10G 1/04* (2006.01)

(52) U.S. Cl.
CPC ..... *C10G 1/047* (2013.01); *C10G 2300/4062* (2013.01); *C10G 2300/80* (2013.01)

(58) Field of Classification Search
CPC ..... C10G 1/047; C10G 2300/4062; C10G 2300/80
See application file for complete search history.

(56) References Cited

U.S. PATENT DOCUMENTS

| | | | |
|---|---|---|---|
| 4,605,068 | A | 8/1986 | Young et al. |
| 4,664,818 | A | 5/1987 | Halliday et al. |
| 5,197,544 | A | 3/1993 | Himes |
| 5,728,653 | A | 3/1998 | Audibert et al. |
| 5,771,971 | A | 6/1998 | Horton et al. |
| 5,908,814 | A | 6/1999 | Patel et al. |
| 6,247,543 | B1 | 6/2001 | Patel et al. |
| 6,484,821 | B1 | 11/2002 | Patel et al. |
| 6,544,933 | B1 | 4/2003 | Reid et al. |
| 6,609,578 | B2 | 8/2003 | Patel et al. |
| 7,091,159 | B2 | 8/2006 | Eoff et al. |
| 9,458,386 | B2 | 10/2016 | Long |

(Continued)

FOREIGN PATENT DOCUMENTS

| | | | |
|---|---|---|---|
| CA | 2794372 | C | 5/2014 |
| CA | 2880959 | C | 7/2015 |

(Continued)

OTHER PUBLICATIONS

Sanford, E.C. and F.A. Seyer, "Processibility of Athabasca Tar Sand Using a Batch Extraction Unit: The Role of NaOH", Can. Inst. Min. Metall. Bull., 72(803), 164-169 (1979).

(Continued)

*Primary Examiner* — Randy Boyer
*Assistant Examiner* — Brandi M Doyle
(74) *Attorney, Agent, or Firm* — Bennett Jones LLP

(57) ABSTRACT

A method for extracting bitumen from an oil sands ore comprising swelling clays such as smectite is provided comprising blending said ore sands ore comprising swelling clays with a substantially swelling clays-free oil sands ore to give a blended oil sands ore having less than 1% swelling clays.

18 Claims, 3 Drawing Sheets

(56) References Cited

U.S. PATENT DOCUMENTS

| | | | | |
|---|---|---|---|---|
| 9,469,814 | B2 | 10/2016 | Long et al. | |
| 2002/0155956 | A1 | 10/2002 | Chamberlain et al. | |
| 2003/0106718 | A1 | 6/2003 | Patel et al. | |
| 2015/0210929 | A1* | 7/2015 | Long ..... | C10G 1/047 208/390 |

FOREIGN PATENT DOCUMENTS

| | | | |
|---|---|---|---|
| CA | 2899348 | C | 10/2015 |
| CA | 2986399 | C | 5/2019 |
| WO | 2006013595 | | 2/2006 |
| WO | 2006013596 | | 2/2006 |
| WO | 2006013597 | | 2/2006 |

OTHER PUBLICATIONS

Xiang Zhou, et al., XRD-based quantitative analysis of clay minerals using reference intensity ratios, mineral intensity factors, Rietveld, and full pattern summation methods: A critical review, Solid Earth Sciences 3 (2018) 16-29.

* cited by examiner

METHODS FOR PROCESSING OIL SANDS CONTAINING SWELLING CLAYS

FIELD OF THE INVENTION

The present invention relates generally to a method for processing oil sand ore containing swelling clays.

BACKGROUND OF THE INVENTION

Oil sand ore, as known in the Athabasca region of Alberta, Canada, comprises water-wet, coarse sand grains having flecks of a viscous hydrocarbon, known as bitumen, trapped between the sand grains. A typical sample of oil sand, for example, might comprise 84% by weight solids, 5% water and 11% bitumen. (All % values stated in this specification are to be understood to be % by weight or wt. %.)

For many decades, the bitumen in Athabasca oil sand has been commercially recovered using a water-based process. In the first step of this process, the oil sand is mixed with process water, naturally entrained air and, optionally, caustic (NaOH) to form a slurry. The slurry is further mixed, for example in a tumbler or pipeline, for a prescribed retention time, to initiate a preliminary separation or dispersal of the bitumen and solids and to induce air bubbles to contact and aerate the bitumen. This step is referred to as "conditioning".

The conditioned slurry is then further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, aerated bitumen rises and forms a froth layer, which overflows the top lip of the vessel and is conveyed away in a launder. Sand grains sink and are concentrated in the conical bottom. They leave the bottom of the vessel as a wet tailings stream containing a small amount of bitumen. Middlings, a watery mixture containing fine solids and bitumen, extend between the froth and sand layers.

The wet tailings and middlings are separately withdrawn. The wet tailings can be either disposed or combined with the middlings for secondary bitumen recovery in a Tailings Oil Recovery (TOR) vessel. The midllings can also be sent alone to mechanical flotation cells or flotation columns for secondary bitumen recovery. The bitumen recovered from the secondary bitumen recovery process is recycled to the PSV. The froth produced by the PSV is subjected to further froth cleaning, i.e., removal of entrained water and solids, prior to upgrading.

Bitumen recovery is generally high when processing average to high grade oil sand ores. Typically, a "low grade" oil sand ore will contain between about 6 to 10 wt. % bitumen with about 25 to 35 wt. % fines. An "average grade" oil sand ore will typically contain at least 10 wt. % bitumen to about 11 wt. % bitumen with less than 30 wt. % fines and a "high grade" oil sand ore will typically contain greater than 11 wt. % bitumen with less than 25 wt. % fines. "Fines" are generally defined as those solids having a size less about 44 μm. In this "Fines" fraction, various mineral species exist, including clays. Generally, kaolinite and illite are the two major clay species in Athabasca oil sands. Swelling clays, such as smectite are only found sporadically in some ores, which are generally not a concern in terms of their impact on bitumen extraction due to their small quantities.

However, in some mine areas, oil sand ores containing significant amounts (e.g., >0.5%) of swelling clays (mainly smectite) exist in large quantities and are distributed in large areas. It is well known that swelling clays (e.g., smectite) have large specific surface areas and exhibit a high expansion (swelling) capability.

It was discovered by the present applicant that, if an oil sand ore with a fines content of 27.5% (<44 μm) with essentially 0% semectite had a bitumen recovery of 94%, the recovery could drop to 60% or below if ~1% semectite existed in the ore. Thus, there is a need in the oil sand industry for a commercially feasible water-based extraction process for dealing with oil sands ore containing significant amounts of swelling clays such as smectite.

SUMMARY OF THE INVENTION

Broadly stated, in one aspect of the invention, a method for extracting bitumen from an oil sands blend comprising a smectite-containing oil sands ore and at least one oil sands ore having substantially no smectite is provided, comprising:

measuring the smectite content of the smectite-containing oil sands ore;

blending the smectite-containing oil sands ore with at least one substantially smectite-free oil sands ore so that the oil sands ore blend has a bitumen content of at least 10.5% and a fines content at or less than about 28% and a smectite content of less than about 1%;

mixing the oil sands ore blend with water in a slurry preparation unit to form an oil sands slurry;

conditioning the oil sands slurry to form a conditioned oil sands slurry; and feeding the conditioned oil sands slurry along with dilution water into a separation zone to form bitumen froth and tailings;

whereby one or more of the following additional steps are performed based on the % smectite in the blended oil sands ore:

(a) adjusting a dosage of caustic, a clay swelling inhibitor, or a secondary process aid, or combinations thereof, either prior to or during the mixing step, or prior to or during the conditioning step, or both;

(b) reducing a feed rate of the blended oil sands ore to the slurry preparation unit such that the density of the conditioned oil sands slurry introduced into the separation zone is reduced from a conventional value of 1.45 g/cc to about 1.4 g/cc or to about 1.35 g/cc or to less than 1.35 g/cc;

(c) adding an additional amount of dilution water to the conditioned oil sands slurry to reduce its conventional density of about 1.45 g/cc to about 1.4 g/cc or below; and (d) increasing the overall processing temperature to between about 55° C. and about 80° C.

In one embodiment, the smectite content is measured directly through sample analyses including by X-ray Diffraction (XRD) measurement.

In one embodiment, the smectite content is represented by the cation exchange capacity (CEC) of the oil sands ore and the CEC is measured through sample analyses or through a geological database or map that provides CEC data or information.

In one embodiment, the separation zone is a gravity separation vessel.

In one embodiment, the additional step is (a), whereby caustic is added at a dosage of 0.05 wt % or higher per tonne dry oil sands ore blend. In one embodiment, the additional step is (a), whereby a secondary process aid is also added at a dosage of about 0.015 wt % per tonne dry oil sands ore blend. In one embodiment, the secondary process aid is sodium citrate. In one embodiment, the additional step is (a), whereby a clay swelling inhibitor is added at a dosage determined based on the smectite content of the oil sands ore blend.

In one embodiment, the additional step is (a), whereby caustic is added at a dosage of 0.05 wt % or higher per tonne dry oil sands ore blend and secondary process aid is sodium citrate added at a dosage of about 0.015 wt % per tonne dry oil sands ore blend. In one embodiment, the additional step is (a), whereby caustic is added at a dosage of 0.1 wt % or higher per tonne dry oil sands ore blend.

In one embodiment, the additional step is (a), whereby secondary process aid is added at a dosage of about 0.1 wt % or higher per tonne dry oil sands ore blend. In one embodiment, the secondary process aid is sodium citrate.

BRIEF DESCRIPTION OF THE DRAWINGS

The invention will now be described by way of exemplary embodiments with reference to the accompanying simplified, diagrammatic, not-to-scale drawings. In the drawings.

DESCRIPTION OF THE PREFERRED EMBODIMENT

Figure 1:
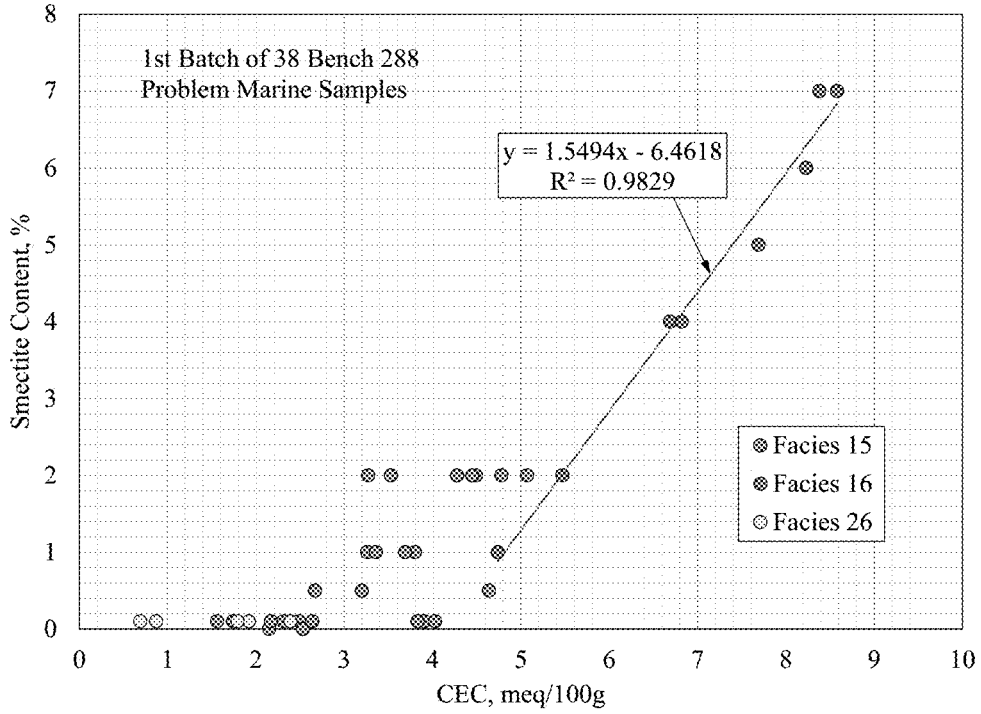
FIG. 1 is a graph showing that the cation exchange capacity (CEC) of an oil sands ore correlates to the % smectite content in the oil sands ore.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

As used herein, "clay minerals" or "clays" are hydrous aluminium phyllosilicates, sometimes with variable amounts of iron, magnesium, alkali metals, alkaline earths, and other cations found on or near some planetary surfaces. Clay minerals include the following groups: Kaolin group which includes the minerals kaolinite, dickite, halloysite, and nacrite (polymorphs of $Al_2Si_2O_5(OH)_4$); Smectite group which includes dioctahedral smectites such as montmorillonite, nontronite and beidellite and trioctahedral smectites for example saponite; Illite group which includes the clay-micas; Chlorite group includes a wide variety of similar minerals with considerable chemical variation; and other 2:1 clay types such as sepiolite or attapulgite, clays with long water channels internal to their structure.

"Swelling clay" or "expansive clay" is a clay soil that is prone to large volume changes (swelling and shrinking) that are directly related to changes in water content. Soils with smectite clay minerals, including montmorillonite and bentonite, have the most dramatic shrink-swell capacity.

As used herein, "smectite clay mineral", or "smectite", is the name used for a group of phyllosilicate mineral species, the most important of which are montmorillonite, beidellite, nontronite, saponite and hectorite. These and several other less common species are differentiated by variations in chemical composition involving substitutions of Al for Si in tetrahedral cation sites and Al, Fe, Mg and Li in octahedral cation sites. Smectite clays have a variable net negative charge, which is balanced by Na, Ca, Mg and, or, H adsorbed externally on interlamellar surfaces. The structure, chemical composition, exchangeable ion type and small crystal size of smectite clays are responsible for several unique properties, including a large chemically active surface area, a high cation exchange capacity, interlamellar surfaces having unusual hydration characteristics, and sometimes the ability to modify strongly the flow behavior of liquids.

As used herein, a "clay swelling inhibitor" is a chemical compound that is able to prevent or reduce clay swelling. It can be any of the commercially available swelling inhibitors. It can be a single chemical (e.g., potassium sorbate, potassium carbonate, potassium bicarbonate, polyacrylamide, or polyvinylacetate, polyanionic cellulose, polyalkylene glycols, etc.) or a formula that contains two or more chemicals. Other useful clay swelling inhibitors may include:

a) inorganic phosphates, described in U.S. Pat. No. 4,605,068 (Young et al.);

b) polyalkoxy diamines and their salts, in U.S. Pat. Nos. 6,484,821, 6,609,578, 6,247,543 and US 20030106718, all by Patel et al.;

c) choline derivatives, as in U.S. Pat. No. 5,908,814 (Patel et al.);

d) oligomethylene diamines and their salts, in U.S. Pat. No. 5,771,971 (Horton et al.), and US 20020155956 (Chamberlain et al.);

e) the addition product of carboxymethyl cellulose and an organic amine, in WO 2006/013595 (Li Bassi et al.)

f) 1,2-cyclohexanediamine and/or their salts, in WO 2006/013597 (Merli et al.);

g) salts of phosphoric acid esters of oxyalkylated polyols, in WO 2006/013596 (McGregor et al.);

h) the combination of a partially hydrolyzed acrylic copolymer, potassium chloride and polyanionic cellulose, in U.S. Pat. No. 4,664,818 (Halliday William S. et al.);

i) quaternary ammonium compounds, in U.S. Pat. No. 5,197,544 (Himes Ronald E.);

l) polymers based on dialkyl aminoalkyl methacrylate, in U.S. Pat. No. 7,091,159 (Eoff, Larry S. et al.);

m) aqueous solutions containing a polymer with hydrophilic and hydrophobic groups, in U.S. Pat. No. 5,728,653 (Audibert, Annie et al.); and n) the reaction product of a polyhydroxyalkane and an alkylene oxide, in U.S. Pat. No. 6,544,933 (Reid, Paul Ian et al.).

As used herein, "secondary process aid" or "SPA", is a chemical compound that is used as a process aid in bitumen extraction alone or in combination with caustic (sodium hydroxide) as the primary process aid. It is selected from the group consisting of sodium citrate, sodium silicate, and sodium triphosphate.

It was discovered by the present applicant that significant levels of smectite clay minerals present in oil sands ore can significantly reduce the bitumen recovery in a water-based oil sand extraction process. This can be seen in Table 1 below.

TABLE 1

Estimate of Bitumen Recovery in the Presence of Smectite

| Smectite in Ore, % | Ore Fines, % <44 μm | | | | | | | | | | | |
|---|---|---|---|---|---|---|---|---|---|---|---|---|
| | 10 | 15 | 17.5 | 20 | 22.5 | 25 | 27.5 | 30 | 32.5 | 35 | 37.5 | 40 |
| 0 | 98 | 97 | 97 | 97 | 96 | 96 | 94 | 92 | 90 | 88 | 85 | 80 |
| 0.16 | 98 | 97 | 97 | 97 | 95 | 94 | 92 | 91 | 89 | 87 | 83 | 77 |
| 0.32 | 97 | 97 | 96 | 95 | 93 | 92 | 90 | 89 | 87 | 83 | 77 | 67 |
| 0.48 | 97 | 96 | 95 | 93 | 91 | 90 | 86 | 85 | 83 | 77 | 67 | 57 |
| 0.64 | 96 | 95 | 93 | 89 | 87 | 86 | 80 | 79 | 77 | 67 | 57 | 47 |
| 0.80 | 95 | 93 | 89 | 83 | 81 | 80 | 70 | 69 | 67 | 57 | 47 | 27 |
| 0.96 | 93 | 89 | 83 | 73 | 71 | 70 | 60 | 59 | 57 | 47 | 27 | 27 |
| 1.12 | 89 | 83 | 73 | 63 | 61 | 60 | 50 | 49 | 47 | 27 | 27 | 17 |
| 1.28 | 83 | 73 | 63 | 53 | 51 | 50 | 30 | 29 | 27 | 27 | 17 | 17 |
| 1.44 | 73 | 63 | 53 | 33 | 31 | 30 | 30 | 29 | 27 | 17 | 17 | 15 |
| 1.60 | 63 | 53 | 33 | 33 | 31 | 30 | 20 | 19 | 17 | 17 | 15 | 15 |

TABLE 1-continued

Estimate of Bitumen Recovery in the Presence of Smectite

| Smectite in Ore, % | Ore Fines, % <44 μm | | | | | | | | | | | |
|---|---|---|---|---|---|---|---|---|---|---|---|---|
| | 10 | 15 | 17.5 | 20 | 22.5 | 25 | 27.5 | 30 | 32.5 | 35 | 37.5 | 40 |
| 2.40 | 53 | 33 | 33 | 23 | 21 | 20 | 18 | 19 | 17 | 15 | 15 | 14 |
| 3.20 | 33 | 33 | 23 | 23 | 21 | 20 | 18 | 17 | 15 | 15 | 14 | 12 |

Table 1 shows that, even with an overall low amount of fines present in the oil sands ore, e.g., 10 wt %, when smectite levels were greater than about 1 wt %, bitumen recovery began to fall (0% smectite resulted in 98% bitumen recovery versus 93% bitumen recovery with 0.96 wt % smectite). Comparable amounts of smectite in higher fines containing oil sand ores resulted in an even more dramatic decrease in bitumen recovery. For example, for an oil sands ore having 25 wt % fines, a bitumen recovery of 96% with 0% smectite could drop to 71% with 0.96 wt % smectite in the ore.

It is believed that the high swelling capacity of smectite is the root cause of the poor processability of oil sands ores with significant smectite concentrations (i.e., >0.5%). It is believed that fundamentally it is the swelling of smectite that results in a significantly increased slurry viscosity which makes bitumen flotation and solids settling very difficult in the PSVs (primary separation vessels).

Table 2 below shows that when dealing with smectite containing oil sands ores, the use of standard operating conditions including the use of chemical aids at normal dosages based on their ore grade and fines content did not improve the overall bitumen extraction performance. Three different oil sands ore samples were taken from a particularly high smectite ore bench, namely, bench 288. A Batch Extraction Unit (BEU) was used to test these samples. The BEU is a low-shear laboratory approximation of the Clark Hot Water Extraction Process. It typically produces a froth similar to that obtained from the traditional commercial process with conditioning and separation stages. Froth is produced in two stages with the BEU: a "primary froth" and a "secondary froth." A detailed description of the steps and variables involved in the BEU extraction can be found at Sanford, E. C. and F. A. Seyer, "Processibility of Athabasca Tar Sand Using a Batch Extraction Unit: The Role of NaOH", *Can. Inst. Min. Metall. Bull.,* 72(803), 164-169 (1979).

TABLE 2

Results of BEU Tests with the Use of Chemical Aids at Normal Dosages

| Oil Sand Info | | | | | Chemical Dose, % | | Bitumen Recovery % | | Primary Froth Quality % | | |
|---|---|---|---|---|---|---|---|---|---|---|---|
| # | % of Bench 288 ore | Grade % | Fines % <44 um | Smectite % | Caustic | SPA | Primary | Combined | B | W | S |
| 1 | 100 | 9.9 | 19.5 | 1 | 0 | 0 | 22.5 | 61.6 | 46.3 | 47.9 | 5.8 |
| | | | | | 0.04 | 0 | 7.1 | 11.7 | 33.1 | 62.0 | 5.0 |
| | | | | | 0.01 | 0.005 | 43.6 | 49.9 | 40.5 | 52.9 | 6.5 |
| 2 | 100 | 8.9 | 19.9 | 4 | 0 | 0 | 1.4 | 1.6 | 7.5 | 83.6 | 8.9 |
| | | | | | 0.05 | 0 | 1.0 | 1.3 | 9.0 | 84.6 | 6.4 |
| | | | | | 0.025 | 0.005 | 0.5 | 0.7 | 6.6 | 89.1 | 4.4 |
| 3 | 100 | 11.5 | 12.2 | <1 | 0 | 0 | 10.0 | 16.4 | 14.5 | 61.9 | 23.6 |
| | | | | | 0.015 | 0 | 7.4 | 38.7 | 21.1 | 74.6 | 4.4 |
| | | | | | 0.01 | 0.005 | 34.4 | 71.8 | 21.1 | 41.0 | 37.9 |

As can be seen from Table 2, sample #1 had a lower-than-average grade at 9.9% but its fines content was also low at 19.5%<44 μm. This sample contained 1% of smectite. This sample had very poor extraction performance without the use of any aids. However, the use of caustic at 0.04% led to even poorer performance as the recoveries obtained were extremely low. This indicates that the use of caustic was not able to improve the processability of this bench 288 ore at all. As for the combined use of caustic and SPA, a higher primary recovery was obtained but the combined recovery was lower than that of the base case run and the froth quality was poorer. This indicates that the combination of caustic and SPA as tested at these low dosages did not improve the overall extraction performance.

Sample #2 had a low fines content at ~20%<44 μm, but it had a low grade at 9.9%, a very high smectite content at 4%. The recoveries obtained for this ore were close to zero and the froth bitumen contents were even lower than the bitumen content in the ore. The use of the chemical aids, including the use of caustic up to 0.05% and the combined use of caustic at 0.025% and SPA at 0.005% did not provide any improvement at all.

Sample #3 was a high grade ore (11.5%) with a very low fines content at only 12.2%<44 μm and it had a <1% of smectite content. When no chemicals were used, this ore was processed very poorly with very low recovery and extremely poor froth quality. With the use of caustic, even though the combined recovery slightly increased as compared to the base case, the overall performance was still extremely poor. As for the use of caustic in combination with SPA, both the primary and combined recoveries were significantly increased but the primary froth bitumen content was still very low at only ~21%. What is even worse is that the froth solids content became extremely high at ~38%. This indicates that the combined use of caustic and SPA at the relative low dosages as used was not able to improve the overall performance for this ore. In addition to the presence of smectite in this ore, other factors could also contribute to its poor processability.

In summary based on the results of all 3 samples from the 288 bench, it can be concluded that the use of caustic or a combined use of caustic and SPA at the dosages tested was not able to improve the overall extraction performance or the processability of these bench 288 ores that contained variable amounts of smectite.

The same three oil sand samples from the 288 bench were also tested at a higher processing temperature of 82° C. The results in Table 3 below show that even processing at 82° C. was not able to provide any improvement in the processability of these very poor processing ores from bench 288 that contained smectite.

TABLE 3

Results of BEU Runs 82° C.

| Oil | Temperature, ° C. | | Bitumen Recovery % | | Primary Froth Quality % | | |
|---|---|---|---|---|---|---|---|
| Sand # | Slurring | Flooded | Primary | Combined | B | W | S |
| 1 | 82 | 82 | 6.5 | 10.5 | 29.6 | 68.8 | 1.6 |
| 2 | 82 | 82 | 0.8 | 0.9 | 15.1 | 79.3 | 5.6 |
| 3 | 82 | 82 | 7.1 | 43.1 | 22.4 | 74.4 | 3.2 |

Table 4 below shows the variability in the amount of smectite present in oil sands ore samples taken from bench 288. While smectite was detected in all of the samples, the amount detected varied from sample to sample. Further, Table 4 shows that these samples had high variability in terms of grade and fines content.

TABLE 4

Oil Sand Samples from Bench 288

| Oil Sand ID | % of Bench 288 Ore | Grade, % | Fines, % < 44 um | Smectite Content, % |
|---|---|---|---|---|
| 190625_288TW | 100 | 9.9 | 19.5 | 1 |
| 190625_288TE | 100 | 8.9 | 19.9 | 4 |
| 190625_288BW | 100 | 11.5 | 12.2 | <1 |
| 190705_288TW | 100 | 12.8 | 13.4 | Trace |
| 190705_288TE | 100 | 10.8 | 24.5 | 1 |
| 190705_288BE | 100 | 6.8 | 39.8 | 4 |
| 190705_288 | 100 | 7.6 | 40.6 | 2 |

Hence, when considering to blend a smectite-containing ores with other ores, it is important to determine the smectite content in the ores so that the amount of smectite in the blend is less than about 1%. This is because tests show that if an oil sands ore (or blend) contains >1% smectite, it can have extremely poor processability and consequently becomes almost non-processable, e.g., oil sand sample #2 listed in Table 2. This ore always had close to zero recovery even with the use of process aids at high dosages (Table 2) or at high processing temperature (Table 3).

The content of smectite and other minerals in an oil sands ore can be directly measured by the standard X-ray Diffraction (XRD) method. Several quantitative methods based on XRD analyses for clay mineral quantification have been developed (e.g., the reference intensity ratio (RIR) method, the mineral intensity factor (MIF) method, the external standard method, the no-standard method, the Rietveld method, and the full pattern summation method). Explanations of each of these methods can be found in the recent publication, Xiang Zhou, et al., *XRD—based quantitative analysis of clay minerals using reference intensity ratios, mineral intensity factors, Rietveld, and full pattern summation methods: A critical review*, Solid Earth Sciences 3 (2018) 16-29.

However, the XRD method is complicated, time-consuming, and costly. As described below, it was found by the current applicant that cation exchange capacity (CEC) of the solids in oil sands had good correlations with smectite content and fines content of the oil sands and it can be used as an alternative to XRD and a good indicator showing the presence of smectite.

A relatively quick and effective way to measure CEC of an oil sand solids samples is as follows. Copper triethylenetetramine complex (CuTrien) solution is added to a sample consisting of cleaned and dried solids, dispersed in a sodium bicarbonate buffer pH adjusted to 9.6. CuTrien index cation binds to negative surfaces of minerals within the dispersed solids. This binding removes some CuTrien from the solution. The resulting solution is filtered and the final CuTrien complex concentration is quantified using a UV-Vis spectrometer measuring at 577 nm. The difference between the initial and final concentration of the CuTrien complex is used along with the dried sample weight to determine the cation-exchange capacity (CEC) of the sample. The CEC is reported in units of milli-equivalents of cations per one hundred grams of dry solids (meq/100 g). However, it is understood that other methods for determining cation exchange capacity of an oil sand solids sample, which are known in the art, can be used.

The relationship between the CEC of a sample and the % smectite is shown in FIG. 1. The CEC (meq/100 g) and the smectite content (%) were determined from a number of samples obtained from three different oil sands ore facies from bench 288, i.e., facies 15, 16 and 26. As can be seen in FIG. 1, CEC was shown to have a strong correlation with the smectite content when the ores contained a significant amount of smectite, e.g., for the facies 16 ore. FIG. 1 also shows that for all bench 288 ore samples with CEC≥3 meq/100 g, smectite (in trace amounts or higher amounts) was detected in these samples. Thus, the use of CEC is particularly useful when dealing with problems ores having a CEC≥3 meq/100 g.

Figure 2:
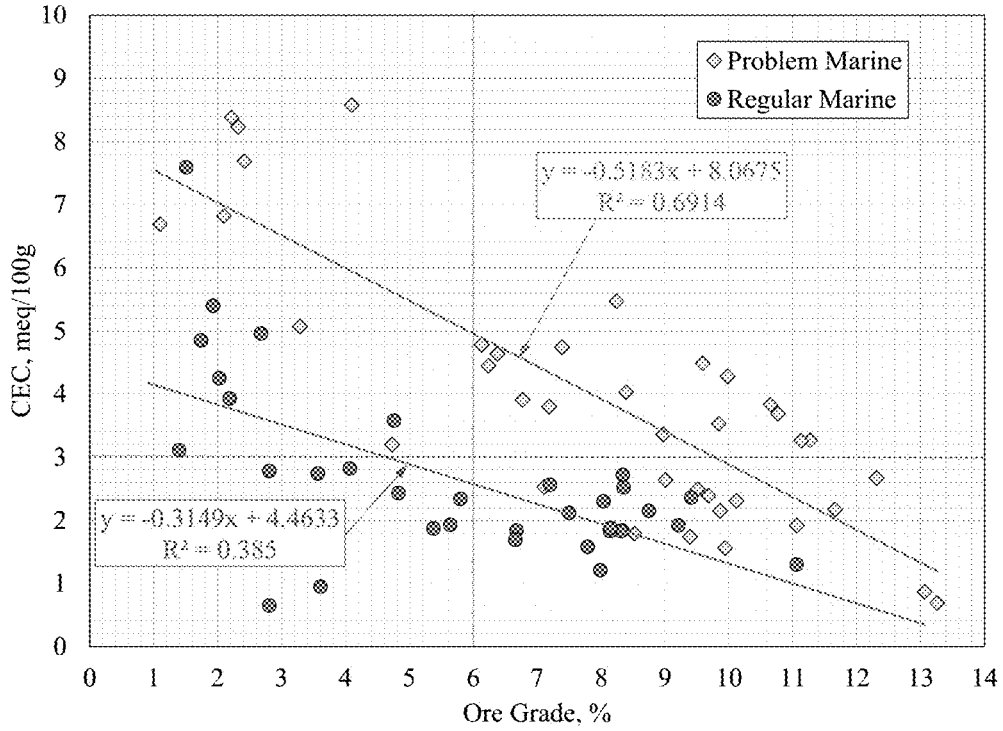
FIG. 2 is a graph showing that problem marine oil sands ore (diamonds) have higher CEC, meq/100 g numbers than regular marine oil sands ore (circles) regardless of oil sands ore grade, % bitumen.
Figure 3:
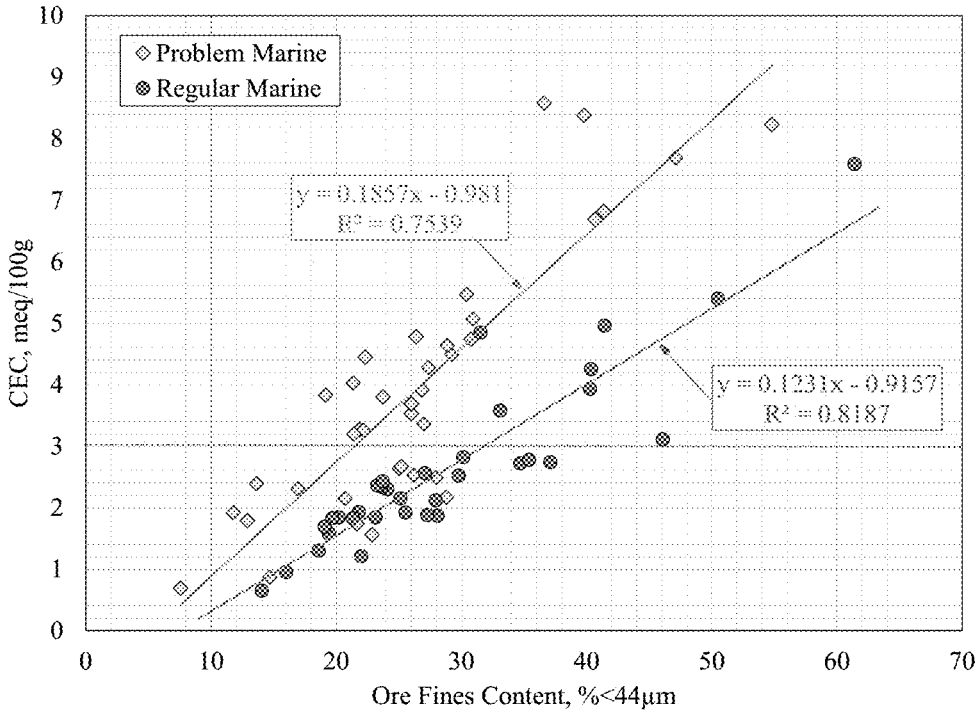
FIG. 3 is a graph showing that problem marine oil sands ore (diamonds) have higher CEC, meq/100 g numbers than regular marine oil sands ore (circles) regardless of ore fines content, %<44 μm.
Figure 4:
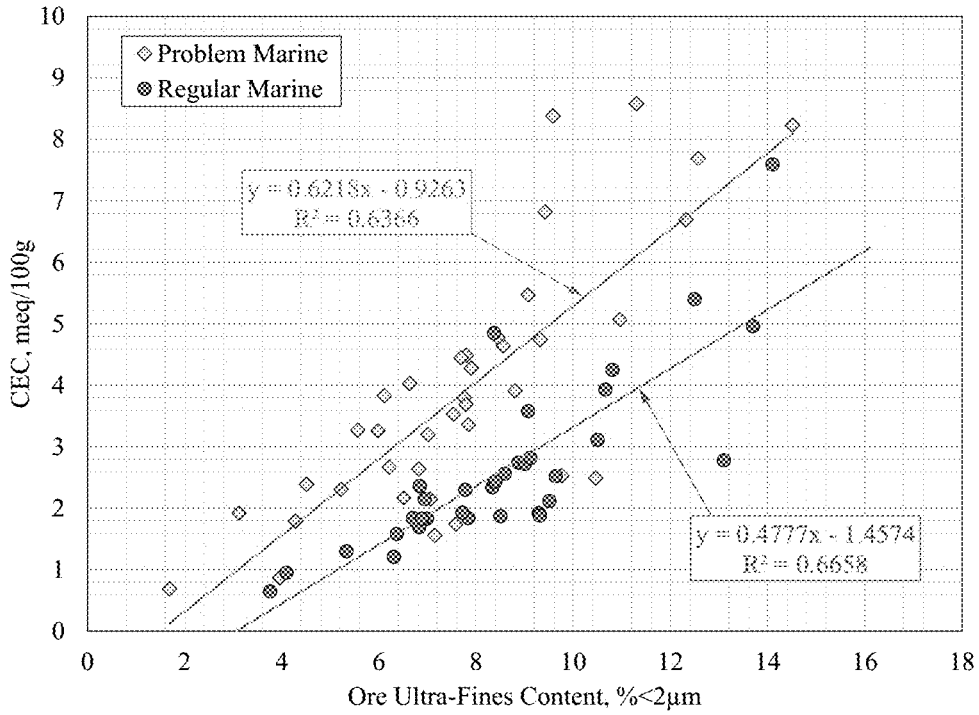
FIG. 4 is a graph showing that problem marine oil sands ore (diamonds) have higher CEC, meq/100 g numbers than regular marine oil sands ore (circles) regardless of ore ultra-fines content, %<2 μm.

It was also found that the problem marine ores from bench 288 that caused recovery issues had much higher CEC values than the regular marine ores that did not cause recovery issues when the qualities of these ores (e.g., grade, fines content, ultra-fines content) were the same or similar. FIG. 2 shows that for similar ore grades (% bitumen), problem marine ores (diamonds) exhibited a much higher CEC than regular marine ores (circles). Similarly, FIG. 3 shows that for ores having the same fines content (%<44 μm), problem marine ores (diamonds) exhibited a much higher CEC than regular marine ores (circles). Finally, FIG. 4 shows that for ores having the same ultra-fines content (%<2 μm), problem marine ores (diamonds) exhibited a much higher CEC than regular marine ores (circles).

The following examples illustrate several strategies that were investigated to improve the recovery of bitumen from oil sands ores having significant smectite concentrations.

Example 1

Figure 5:
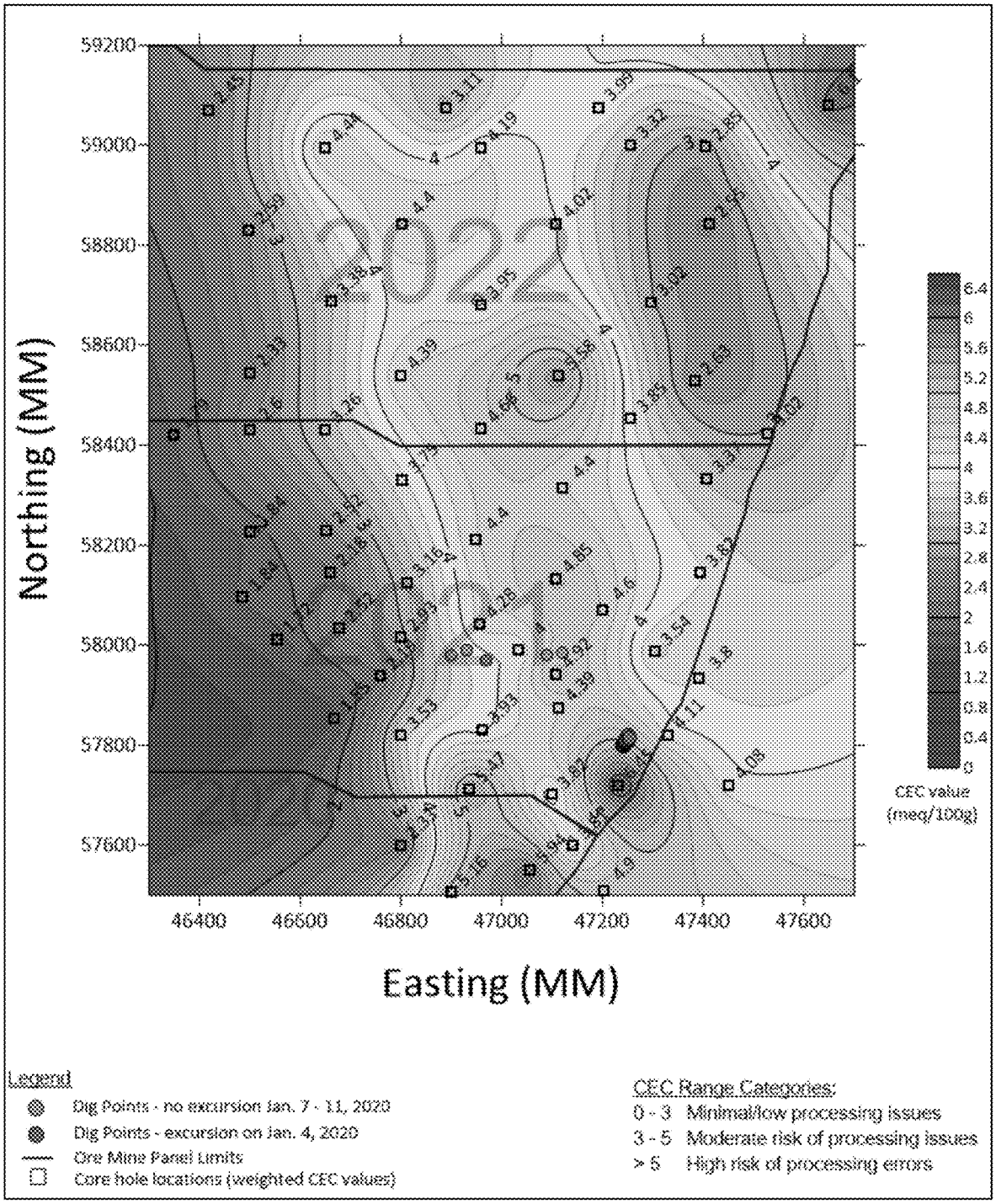
FIG. 5 is a CEC map for North Mine Bench 288 marine ore, which illustrates areas of high smectite content.

In this example, the use of blending high-smectite oil sands ore with oil sands ore having no or trace amounts of smectite was explored to improve processability of high smectite ores. CEC was used as a control parameter and a CEC map was developed for North Mine Bench 288 marine ore (FIG. 5), which shows the average CEC value for the entire 288 marine bench for the mining area up to 2022.

The pink dots on the map are the dig points where CEC values are higher. When the ore from these pink points were processed, recovery excursions were experienced. The green dots are dig points where the CEC values are lower. When the ore from these green points were processed, good recovery was obtained. This shows that the CEC data provides a good indication of ore processability and can be used as an indicator of ore processability in mine planning.

CEC was used to control the ratio of the 288 marine ore in the feed blend. For example, for the ore from the green dots area with low CEC values in FIG. 5, the content of 288 marine ore in the feed blend can be increased to ~30% with no recovery excursion to be expected. However, for the ore from the pink dots area with high CEC values, the content of 288 marine ore in the feed blend should be reduced, e.g., 520%, to ensure good recovery. This indicates that this CEC map or CEC values can be used to optimize daily mine plans for ore blending to maximize extraction performance.

In addition, a variety of ore blends were also tested. The high smectite containing oil sands ore (referred to as 288) was added in varying amounts (30%, 35% and 40%) to good processing oil sands ores. Also, the smectite containing ore was also mined at different locations in the mine, i.e., Bottom 288 and Top East 288, both blended (35%) with a good processing ore. Each blend was treated with 0.05% NaOH and 0.015% sodium citrate as the SPA. Table 5 below provides the results of BEU tests. It can be seen from Table 5 that the use of caustic (0.05%) plus SPA (0.015%) significantly improved both bitumen recovery and bitumen froth quality for all blends tested. With the use of these chemicals, the primary bitumen recoveries obtained were high in the range of 82 to 91% and the combined recovery was from 89% to as high as ~95%. More importantly, the primary froth (Pri. Froth) had a bitumen content at 57% or higher which is very close to the quality of commercial bitumen froth product.

TABLE 5

Results for Various Oil Sands Ore Blends that Contained 288 Marine Ore

| | Oil Sand Info | | | | | | | | | | | |
|---|---|---|---|---|---|---|---|---|---|---|---|---|
| | | % of bench 288 | Grade | Fines % | Aid Dose, % | | Recovery, % | | Pri. Froth | | Comb. Froth | |
| Run | Description | ore | % | <44 um | NaOH | SPA | Primary | Combined | % B | % W | % B | % W |
| 1 | Blend of | 30 | 9.7 | 32.3 | 0 | 0 | 49.7 | 83.0 | 21.6 | 69.2 | 19.1 | 71.0 |
| 6 | Jan. 21, 2020 | | | | 0.05 | 0.015 | 90.1 | 94.8 | 56.6 | 29.7 | 47.9 | 36.7 |
| 7 | Blend of | 30 | 9.1 | 34.7 | 0 | 0 | 44.0 | 57.1 | 27.9 | 62.9 | 26.2 | 65.0 |
| 8 | Jun. 10, 2019 (30% 288) | | | | 0.05 | 0.015 | 87.4 | 90.5 | 58.1 | 30.8 | 56.3 | 32.2 |
| 9 | Blend of | 40 | 9.4 | 27.2 | 0 | 0 | 31.1 | 44.3 | 31.8 | 61.6 | 26.6 | 66.1 |
| 10 | Jun. 10, 2019 (40% 288) | | | | 0.05 | 0.015 | 81.5 | 89.1 | 56.9 | 33.1 | 55.0 | 34.5 |
| 11 | Blend of | 35 | 9.7 | 25.7 | 0 | 0 | 45.0 | 77.1 | 39.4 | 53.4 | 33.1 | 58.5 |
| 12 | Jul. 5, 2019 (35% Bottom 288) | | | | 0.05 | 0.015 | 89.1 | 91.2 | 63.0 | 25.1 | 60.3 | 27.2 |
| 13 | Blend of | 35 | 10.8 | 21.3 | 0 | 0 | 68.9 | 89.4 | 50.1 | 41.7 | 44.4 | 45.6 |
| 14 | Jul. 5, 2019 (35% Top East 288) | | | | 0.05 | 0.015 | 90.8 | 91.5 | 62.7 | 23.4 | 62.0 | 24.2 |

Further, BEU tests were performed on oil sands ore containing 1% smectite from the top west of bench 288 sampled on Jun. 25, 2019 from the mining field. It can be seen in Table 6 below that the use of a very high dosage of either caustic or SPA (0.1% or higher) was able to significantly improve both bitumen recovery and bitumen froth quality.

TABLE 6

BEU Results for 100% 288 Marine Ore Treated with NaOH and SPA

| | Oil Sand Info | | | | | | | | | | | | |
|---|---|---|---|---|---|---|---|---|---|---|---|---|---|
| | | % of bench | Grade | Fines % | | Aid Dose, % | | Recovery, % | | Pri. Froth | | Comb. Froth | |
| Run | Description | 288 | % | <44 um | Smectite | NaOH | SPA | Primary | Combined | % B | % W | % B | % W |
| 15 | Jun. 25, 2019 | 100 | 10.0 | 18.8 | 1% | 0 | 0 | 22.5 | 61.6 | 46.3 | 47.9 | 48.7 | 44.7 |
| 16 | N16-288 | | | | | 0.1 | 0 | 81.0 | 86.8 | 56.2 | 34.0 | 53.3 | 37.0 |
| 17 | Top West | | | | | 0 | 0.1 | 82.9 | 90.3 | 60.3 | 62.9 | 26.2 | 65.0 |

Example 2

In this example, the effects of both feed rate and dilution of smectite containing oil sands ore slurries into a separation zone, such as that in a primary separation vessel, on bitumen recovery or PSV were investigated. In this example, CEC values of various Bench 288 Ore were determined as an indicia of the amount of smectite in the ore.

Table 7 below summarizes the results of the tests at Plant 5 from Feb. 4 to 6, 2020. The normal amounts of dilution water/flood water are typically in the range of 250 to 300 l/s. By controlling the feed rate to be low and the dilution water rate to be high (>600 l/s) with 4 PSVs in operation, the recoveries were maintained to be high (>92%) for feed containing bench 288 ore with CEC up to 4.4 meq/100 g.

TABLE 7

| | Bench 288 Ore | | Oil Sand Feed Info | | | | | Bitumen |
|---|---|---|---|---|---|---|---|---|
| Date | CEC range | % in Feed | Rate, TPH | Grade % | Fines, % <44 μm | Marine (%) | Dilution Water (l/s) | Recovery (%) |
| Feb. 4, 2020 | 3.1-3.4 | 20-25 | 10559 | 10.5 | 31.3 | 19.4 | 637.2 | 94.1 |
| Fe.b 5, 2020 | 3.7-3.9 | | 10050 | 10.6 | 30.3 | 21.2 | 785.3 | 92.2 |
| Feb. 6, 2020 | 4.2-4.4 | | 10194 | 11.0 | 29.7 | 24.5 | 791.0 | 94.1 |
| Normal Dilution for comparison: | | | | | | | | |
| Jan. 20, 2020 | 4.2-4.4 | 32 | 10386 | 10.5 | 27.4 | 31.9 | 159 | 70.5 |
| Jan. 21, 2020 | 4.2-4.4 | 30 | 9479 | 10.6 | 26.7 | 30.6 | 312 | 73.2 |

Interpretation

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of 5%, 10%, 20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

What is claimed:

1. A method for extracting bitumen from an oil sands ore blend comprising a smectite-containing oil sands ore and at least one oil sands ore having substantially no smectite is provided, comprising:

measuring the smectite content of the smectite-containing oil sands ore;

blending the smectite-containing oil sands ore with the at least one substantially smectite-free oil sands ore so that the oil sands ore blend has a bitumen content of at least 10.5% and a fines content at or less than about 28% and a smectite content of less than about 1%;

mixing the oil sands ore blend with water in a slurry preparation unit to form an oil sands slurry;

conditioning the oil sands slurry to form a conditioned oil sands slurry; and feeding the conditioned oil sands slurry along with dilution water, such that the conditioned oil sands slurry has a density of about 1.45 g/cc, into a separation zone to form bitumen froth and tailings;

whereby one or more of the following additional steps are performed based on the % smectite in the blended oil sands ore:

(a) adjusting a dosage of caustic, a clay swelling inhibitor, or a secondary process aid, or combinations thereof, either prior to or during the mixing step, or prior to or during the conditioning step, or both;

(b) reducing a feed rate of the blended oil sands ore to the slurry preparation unit to reduce the density of the conditioned oil sands slurry that is fed into the separation zone from the density of about 1.45 g/cc to a density of about 1.4 g/cc or about 1.35 g/cc or less than 1.35 g/cc;

(c) adding an additional amount of dilution water to the conditioned oil sands slurry to reduce its density of about 1.45 g/cc to about 1.4 g/cc or below; and (d) increasing an overall processing temperature to between about 55° C. and about 80° C.

2. The method as claimed in claim 1, wherein smectite content is measured through sample analyses including by X-ray Diffraction (XRD), Cation Exchange Capacity (CEC) of the samples, or through a geological database or map that provides related CEC data or information.

3. The method as claimed in claim 1, wherein the additional step is (a) and caustic is added at a dosage of 0.05 wt % or higher per tonne dry oil sands ore blend and clay swelling inhibitor is added at a dosage determined based on the smectite content of the oil sands ore blend.

4. The method as claimed in claim 3, wherein secondary process aid is also added at a dosage of about 0.015 wt % per tonne dry oil sands ore blend.

5. The method as claimed in claim 4, wherein the secondary process aid is sodium citrate.

6. The method as claimed in claim 1, wherein the additional step is (a) and caustic is added at a dosage of 0.05 wt % or higher per tonne dry oil sands ore blend and secondary process aid is added at a dosage of about 0.015 wt % per tonne dry oil sands ore blend.

7. The method as claimed in claim 1, wherein the additional step is (a) and caustic is added at a dosage of 0.1 wt % or higher per tonne dry oil sands ore blend.

8. The method as claimed in claim 1, wherein the additional step is (a) and secondary process aid is added at a dosage of about 0.1 wt % or higher per tonne dry oil sands ore blend.

9. The method as claimed in claim 8, wherein the secondary process aid is sodium citrate.

10. The method of claim 1, wherein the separation zone is a gravity separation vessel.

11. The method of claim 2, wherein the separation zone is a gravity separation vessel.

12. The method of claim 3, wherein the separation zone is a gravity separation vessel.

13. The method of claim 4, wherein the separation zone is a gravity separation vessel.

14. The method of claim 5, wherein the separation zone is a gravity separation vessel.

15. The method of claim 6, wherein the separation zone is a gravity separation vessel.

16. The method of claim 7, wherein the separation zone is a gravity separation vessel.

17. The method of claim 8, wherein the separation zone is a gravity separation vessel.

18. The method of claim 9, wherein the separation zone is a gravity separation vessel.

* * * * *